US010408396B2

(12) United States Patent
Wronski et al.

(10) Patent No.: US 10,408,396 B2
(45) Date of Patent: Sep. 10, 2019

(54) JUNCTION BOX FOR REGRESSED LIGHT MODULE

(71) Applicant: Cooper Technologies Company, Houston, TX (US)

(72) Inventors: Grzegorz Wronski, Peachtree City, GA (US); Steven Walter Pyshos, Peachtree City, GA (US); Oliver Ernst, Peachtree City, GA (US); Rongxiu Huang, Shanghai (CN)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 15/707,031

(22) Filed: Sep. 18, 2017

(65) Prior Publication Data

US 2019/0086043 A1 Mar. 21, 2019

(51) Int. Cl.

| | |
|---|---|
| ***F21S 8/02*** | (2006.01) |
| ***F21V 21/30*** | (2006.01) |
| ***F21V 21/04*** | (2006.01) |

(52) U.S. Cl.

CPC ..... *F21S 8/026* (2013.01); *F21V 21/04* (2013.01); *F21V 21/30* (2013.01)

(58) Field of Classification Search

CPC ..... F21S 8/02; F21S 8/026; H02G 3/081
See application file for complete search history.

(56) References Cited

U.S. PATENT DOCUMENTS

| | | | | |
|---|---|---|---|---|
| 2,697,535 | A | 12/1954 | Olson | |
| 4,757,908 | A | 7/1988 | Medlin, Sr. | |
| 4,770,311 | A | 9/1988 | Wang | |
| 4,929,187 | A | 5/1990 | Hudson | |
| 5,216,203 | A | 6/1993 | Gower | |
| 5,690,423 | A | 11/1997 | Hentz | |
| 6,051,786 | A | 4/2000 | Gretz | |
| 6,777,615 | B1 | 8/2004 | Gretz | |
| 6,799,982 | B2 * | 10/2004 | Kerr, Jr. | F21V 21/02 439/140 |
| 7,064,269 | B2 | 6/2006 | Smith | |
| 7,297,870 | B1 | 11/2007 | Sartini | |
| 7,429,025 | B1 | 9/2008 | Gretz | |
| 7,465,174 | B1 | 12/2008 | Haggis | |
| 7,510,426 | B2 | 3/2009 | Hwang | |
| 7,771,094 | B2 | 8/2010 | Goode | |
| D633,099 | S | 2/2011 | Van de Ven | |
| 7,963,804 | B2 | 6/2011 | Ma | |
| D642,317 | S | 7/2011 | Rashidi | |

(Continued)

OTHER PUBLICATIONS

Commercial Electric, CER3GR313WHP, CER3GR313BNP, CER3GR313BCBP, Installation Instructions—3" Remodel/New Construction Recessed Lighting Kit, Published 2010 (Year: 2010).*

(Continued)

*Primary Examiner* — Evan P Dzierzynski

(74) *Attorney, Agent, or Firm* — King & Spalding LLP

(57) ABSTRACT

A junction box for a regressed light module includes an upper housing having a top wall and perimeter walls. The perimeter walls form a polygonal shape. The junction box further includes a lower housing having a cylindrical shape. The lower housing has a cavity for receiving a light module. The lower housing is attached to the upper housing. A cavity of the upper housing and the cavity of the lower housing form a cavity of the junction box.

19 Claims, 12 Drawing Sheets

(56) References Cited

U.S. PATENT DOCUMENTS

| | | | | |
|---|---|---|---|---|
| 8,007,295 | B2 | 8/2011 | Lin | |
| D656,262 | S | 3/2012 | Yoshinobu | |
| D673,322 | S | 12/2012 | Van De Ven | |
| D676,263 | S | 2/2013 | Birke | |
| D677,634 | S | 3/2013 | Karcz | |
| 8,839,511 | B2 * | 9/2014 | Krupa | F21S 8/043 29/854 |
| 9,065,264 | B2 | 6/2015 | Cooper | |
| 9,068,722 | B2 | 6/2015 | Wronski | |
| D735,012 | S | 7/2015 | Cowie | |
| D742,325 | S | 11/2015 | Leung | |
| 9,219,341 | B1 | 12/2015 | O'Kefe | |
| 9,281,671 | B2 | 3/2016 | Sathyanarayana | |
| D766,185 | S | 9/2016 | Hagarty | |
| D791,711 | S | 7/2017 | Holton | |
| D791,996 | S | 7/2017 | Holscher | |
| 9,863,619 | B2 | 1/2018 | Mak | |
| D809,465 | S | 2/2018 | Keirstead | |
| 9,964,266 | B2 | 5/2018 | Danesh | |
| D832,218 | S | 10/2018 | Wronski | |
| D833,977 | S | 11/2018 | Danesh | |
| 10,218,109 | B2 | 2/2019 | Mortun | |
| D848,375 | S | 5/2019 | Danesh | |
| D851,046 | S | 6/2019 | Peng | |
| 2010/0110698 | A1 * | 5/2010 | Harwood | F21V 21/04 362/365 |
| 2015/0009676 | A1 | 1/2015 | Danesh | |
| 2015/0233556 | A1 | 8/2015 | Danesh | |
| 2017/0138576 | A1 | 5/2017 | Peng | |

OTHER PUBLICATIONS

Utilitech Pro White Integrated Led Remodel Recessed Light Kit; Loew's website; Oct. 2, 2016.

3" Recessed Light Kit with Swivel Trim and 50 Watt Bulbs, Remodeler's Non-IC Cans, Contractor Pack of 2 Lights; Altair Lighting, Amazon Dec. 19, 2014.

* cited by examiner

JUNCTION BOX FOR REGRESSED LIGHT MODULE

TECHNICAL FIELD

The present disclosure relates generally to lighting fixtures, and more particularly to a junction box for a regressed light engine.

BACKGROUND

In recessed lighting fixtures, junction boxes are often used for placement of lighting drivers and for making safe wiring connections. Typically, a junction box is placed separate from a housing of a recessed light fixture. For example, the junction box may be structurally unattached to the housing that houses a light engine of the recessed lighting fixture, or may be attached to the housing by a joining structure (e.g., an arm). However, in some applications, a structurally separate junction box or a junction box that is attached to the light fixture by a joining structure may be inconvenient and/or undesirable. For example, the space available behind a ceiling may be small or otherwise limited. In some lighting retrofitting projects, use of an existing junction box or installing a separate new junction box may also be challenging and may result in added cost. Further, in cases such as temporary installations (e.g., during building construction phases), use of a junction box that is separate from the lighting fixture may result in added cost. Thus, a solution that uses a junction box integrated with or as part of a lighting fixture may be desirable.

SUMMARY

The present disclosure relates to a junction box for regressed light module. In an example embodiment, a junction box for a regressed light module includes an upper housing having a top wall and perimeter walls. The perimeter walls form a polygonal shape. The junction box further includes a lower housing having a cylindrical shape. The lower housing has a cavity for receiving a light module. The lower housing is attached to the upper housing. A cavity of the upper housing and the cavity of the lower housing form a cavity of the junction box.

In another example embodiment, a recessed lighting assembly includes a junction box that includes an upper housing having a top wall and perimeter walls. The perimeter walls form a polygonal shape. The junction box further includes a lower housing having a cylindrical shape. The lower housing is attached to the upper housing. A cavity of the upper housing and the cavity of the lower housing form a cavity of the junction box. The recessed lighting assembly further includes a light module positioned in a cavity of the lower housing.

These and other aspects, objects, features, and embodiments will be apparent from the following description and the claims.

BRIEF DESCRIPTION OF THE FIGURES

Reference will now be made to the accompanying drawings, which are not necessarily drawn to scale, and wherein.

Figure 1:
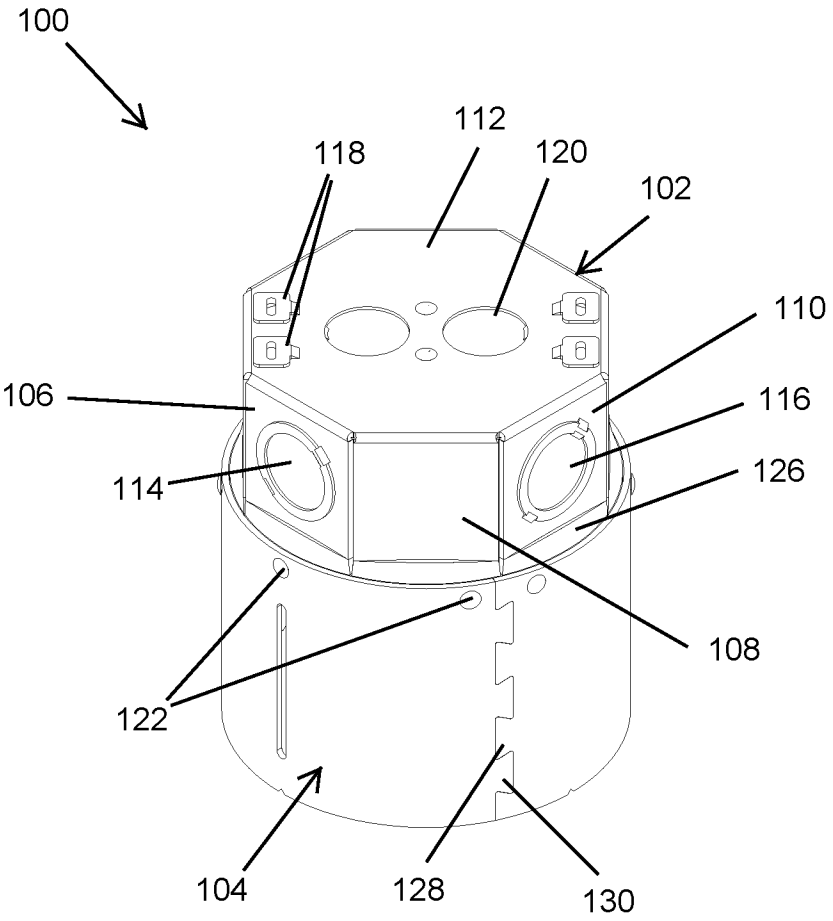
FIG. 1 illustrates a perspective view of a junction box according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals that are used in different figures designate like or corresponding, but not necessarily identical, elements.

DETAILED DESCRIPTION OF EXAMPLE EMBODIMENTS

In the following paragraphs, particular embodiments will be described in further detail by way of example with reference to the figures. In the description, well known components, methods, and/or processing techniques are omitted or briefly described. Furthermore, reference to various feature(s) of the embodiments is not to suggest that all embodiments must include the referenced feature(s).

Turning now to the drawings, FIG. 1 illustrates a perspective view of a junction box 100 according to an example embodiment. In some example embodiments, the junction box 100 may be used with a regressed light module. In some example embodiments, the junction box 100 includes an upper housing 102 and a lower housing 104. The upper housing 102 may include perimeter walls, such as perimeter walls 106, 108, 110, that are connected to form a polygonal shape. For example, the perimeter walls of the upper housing 102 including the perimeter walls 106-108 may form an octagonal shape. In some example embodiments, the upper housing 102 includes a top wall 11. The perimeter walls of the upper housing 102 may extend down from the top wall 112 forming an octagonal shape enclosure.

In some example embodiments, the lower housing 104 has a cylindrical shape. The lower housing 104 may be attached to the upper housing 102 such that at least a portion of the upper housing 102 extends above the lower housing 104. For example, the lower housing 104 may be attached to the upper housing 102 by fasteners 122. The fasteners 122 may be rivets or other types of fasteners.

In some example embodiments, sections of the upper housing 102 may extend out from the perimeter walls of the upper housing 102, such as the perimeter walls 106-110, toward the lower housing 104 to enable attachment of the upper housing 102 to the lower housing 104. For example, section 126 may extend out from the perimeter wall 110 toward the lower housing 104.

In some example embodiments, the upper housing 102 includes knockout sections that can be removed for purposes such as routing wires, conduits, etc. and in general to provide access to the cavity of the junction box 100. For example, the upper housing 102 may include one or more knockout sections 118 and 120 that are formed in the top wall 112 of the upper housing 102. For example, one or more of the knockout sections 118 may be used to route Romex wires into the cavity of the junction box 100. As another example, the one or more of the knockout sections 120 may be used to route a wire conduit into the cavity of the junction box 100.

In some example embodiments, one or more of the perimeter walls of the upper housing 102 may also include knockout sections. For example, the perimeter wall 106 may include a knockout section 114, and the perimeter wall 110 may include a knockout section 116. The knockout sections may have a dimension suitable for various purposes and may be compliant with applicable industry standards. For example, the knockout sections 120, 114, 116 may each have a diameter of ⅞" or 1⅛".

In some example embodiments, one or more of the perimeter walls (e.g., the perimeter walls 106, 110) have a flat surface to provide a suitable location for a knockout section. For example, an opening formed by removing the knockout section 114 may enable a more reliable fit of a wire conduit as compared to an opening formed in a curved surface. In some example embodiments, knockout sections are located on the perimeter walls of the upper housing 102 that are either parallel or perpendicular to hanger bars (e.g., hanger bars 804, 806 shown in FIG. 8) or installation brackets that are used in the installation of the junction box 100. For example, the junction box 100 may be installed such that the perimeter wall 106 is parallel to the hanger bars and the perimeter wall 110 is perpendicular to the hanger bars.

In some example embodiments, the lower housing 104 is designed to receive a light module in a cavity of the lower housing 104. For example, the light module that gets positioned in the cavity of the lower housing 104 may include a light source and a trim as described below in more detail.

In some example embodiments, the junction box 100 may be made from sheet metal using one or more methods such as stamping, cutting, bending, molding, and/or other methods as can be contemplated by those of ordinary skill in the art with the benefit of this disclosure. In some example embodiments, end portions 128, 130 of the lower housing 104 may be press fit to enclose the lower housing 104 and retain the cylindrical shape. Alternatively, fasteners and/or other means may be used. In some alternative embodiments, the junction box 100 may be made from a material other than or in addition to sheet metal.

By using the junction box 100, the need for installation of a junction box that is separate from a lighting fixture housing can be avoided. The junction box 100 can also be used in retrofit installations without the need to install a junction box separate from the lighting fixture and without using an existing junction box that is separate from the lighting fixture. Further, the junction box 100 may be used in installations where space is limited behind a ceiling or other similar structures. Further, temporary lighting fixture installations may be quickly performed without the need for installations of junction boxes that are separate from lighting fixtures.

Although the upper housing 102 is shown as having an octagonal shape, in alternative embodiments, the upper housing 102 may have another polygonal shape without departing from the scope of this disclosure. For example, the upper housing 102 may have fewer or more perimeter walls, such as the perimeter walls 106-110, than shown without departing from the scope of this disclosure. In some alternative embodiments, the upper housing 102 may include more or fewer knockout sections than shown without departing from the scope of this disclosure. In some alternative embodiments, one or more of the perimeter walls of the upper housing 102 may have a curved surface. In some alternative embodiments, the top wall 112 of the upper housing 102 may have a different shape and/or surface than shown without departing from the scope of this disclosure.

Figure 2:
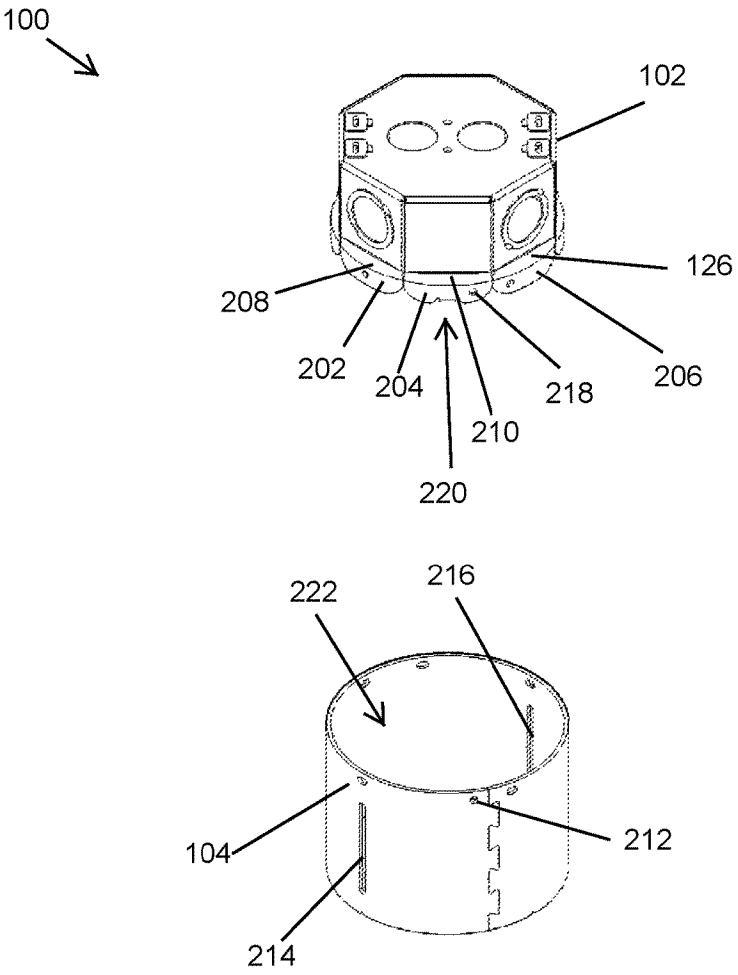
FIG. 2 illustrates an exploded view of the junction box of FIG. 1 according to an example embodiment.

FIG. 2 illustrates an exploded view of the junction box 100 of FIG. 1 according to an example embodiment. Referring to FIGS. 1 and 2, in some example embodiments, the upper housing 102 includes outer sections, including outer sections 202, 204, 206, that may come in contact with the housing 102 when the upper housing 102 is attached to the lower housing 104. For example, the outer sections 202, 204, 206 extend down from sections 208, 210, 126, respectively. The sections 208, 210, 126 may extend out from the perimeter walls 106, 108, 110, respectively. Other sections of the upper housing 102 may extend out from respective perimeter walls in a similar manner, and other outer sections of the upper housing 102 may extend down in a similar manner.

In some example embodiments, the upper housing 102 has a cavity 220. For example, electrical wire connectors and wires may be placed in the cavity 220 of the upper housing 102. To illustrate, electrical wires (with or without a connector) may be inserted into the cavity 220 of the upper housing 102 through an opening formed by removing out a knockout section (e.g., the knockout section 114) of the upper housing 102, and the electrical wires may be connected to a wire connector disposed in the cavity 220 of the upper housing 102.

In some example embodiments, the upper housing 102 and the lower housing 104 may have corresponding holes for attaching the upper housing 102 with the lower housing 104 using fasteners such as the fasteners 122 (e.g., rivets). For example, the outer section 204 of the upper housing 102 may have a hole 218 that can be lined up with a hole 212 in the lower housing 104, and a fastener may be extended in the holes 212, 218 to securely attach the upper housing 102 to the lower housing 104.

In some example embodiments, the outer sections of the upper housing 102, including the outer sections 202-206, may have curved surfaces that match the curvature of the lower housing 104. The curved surfaces of the outer sections of the upper housing 102 can enable a fitting attachment of the upper housing 102 with the lower housing 104. In some example embodiments, the upper housing 102 may be attached to the lower housing 104 in a different manner than shown without departing from the scope of this disclosure.

In some alternative embodiments, the diameter of a round shape formed by the outer sections, including the outer sections 202-206, of the upper housing 102 may be larger than a diameter of the lower housing 104. In such embodiments, the outer sections of the upper housing 102 may be positioned on the outside of the lower housing 104, and the upper housing 102 and the lower housing 104 may be attached to each other in a similar manner as described above.

In some alternative embodiments, the perimeter walls, including the perimeter walls 106-110, of the upper housing 102 may have a larger diameter than the diameter of the shape formed by the outer sections, including the outer sections 202-206, of the upper housing 102. In such embodiments, the perimeter walls may extend beyond the lower housing 104.

In some example embodiments, the lower housing 104 has a cavity 222. The cavity 220 of the upper housing 102 and the cavity 222 of the lower housing 104 may form a single cavity of the junction box 100. To illustrate, one or more wire connectors, wires, a lamp socket, a bracket, etc. may be placed in the cavity of the junction box 100 and may be accessed through the lower opening of the lower housing 104 from below the junction box 100 after the junction box 100 is installed, for example, in a ceiling. Because the cavities 220, 222 form a single cavity of the junction box 100, wire connections inside the junction box 100 may be made and checked from below the junction box 100, which avoids the need for a separate access to the cavity 220 of the upper housing 102.

For example, a light module may be positioned in the cavity of the junction box 100 below a bracket that is inside and attached to the junction box 100. A wire connector may be disposed on or above the bracket, and one or more wires connected to the wire connector may be routed to the light module that is disposed in the cavity of the junction box 100 below the bracket. After the junction box 100 is installed in a ceiling, wire connections, including connections of wires that carry line power, that are inside the junction box 100 can be checked from below the ceiling without the need to access the upper housing 102 from behind the ceiling.

In some example embodiments, the lower housing 104 includes slots 214, 216. For example, the slots 214, 216 may be used to attach installation brackets to the lower housing 104. For example, installation brackets may be used to install a recessed lighting fixture/assembly that includes the junction box 100.

In some example embodiments, the slots 214, 216 may be elongated slots. For example, the slots 214, 216 may enable adjustment of the position of the junction box 100, which may allow use of the junction box 100 with ceilings of various thicknesses and in spaces between a ceiling and support structures such as joists. To illustrate, the slots 214, 216 may enable vertical adjustment of the junction box 100.

In some alternative embodiments, the slots 214, 216 may have a different shape than shown without departing from the scope of this disclosure. In some alternative embodiments, the lower housing 104 may include holes instead of or in addition to the slots 214, 216 for attaching installation brackets or other installation structures to the junction box 100. In some alternative embodiments, the slots 214, 216 may be omitted, and the junction box 100 may be installed by other means without departing from the scope of this disclosure. In some alternative embodiments, the slots 214, 216 may be at different locations than shown without departing from the scope of this disclosure. In some alternative embodiments, the lower housing 104 may include other slots without departing from the scope of this disclosure.

Figure 3:
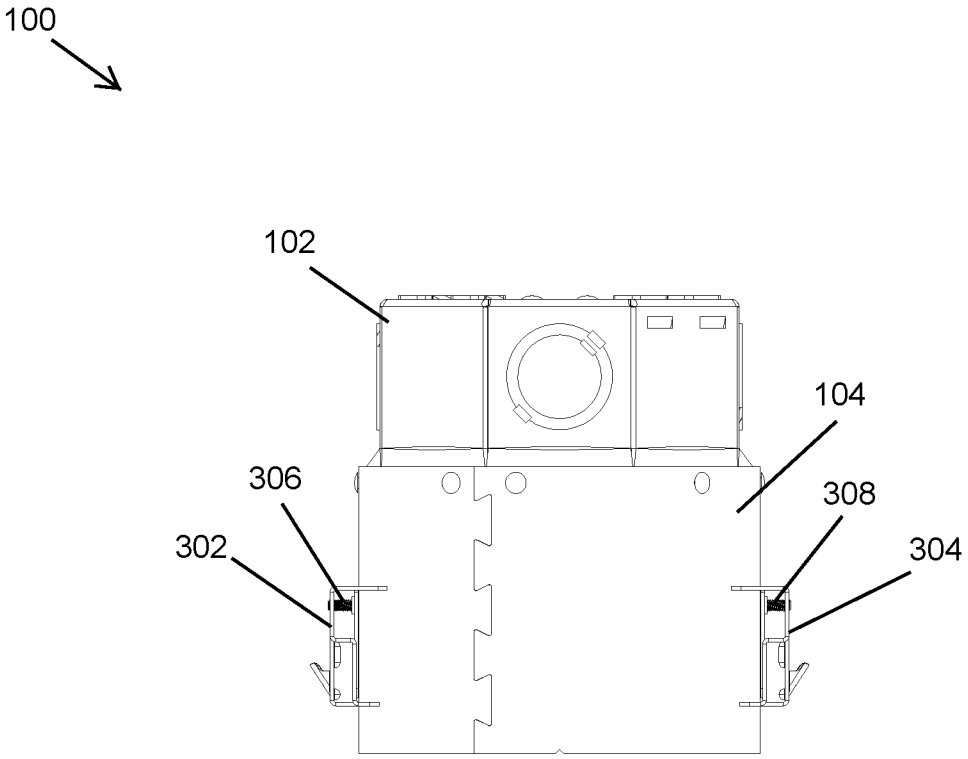
FIG. 3 illustrates a side view of the junction box of FIG. 1 according to another example embodiment.

FIG. 3 illustrates a side view of the junction box 100 of FIG. 1 according to another example embodiment. Referring to FIGS. 1-3, in some example embodiments, junction box 100 includes the upper housing 102, the lower housing 104, and installation brackets 302, 304 that are attached to the lower housing 104. For example, a fastener 306 may be used to attach the installation bracket 302 to the lower housing 104, and a fastener 308 may be used to attach the installation bracket 304 to the lower housing 104. The installation brackets 302, 304 may be used to attach respective hanger bars to install the junction box 100 or a lighting fixture/assembly that includes the junction box 100.

In some example embodiments, the fastener 306 may extend through the slot 214 to attach the installation bracket 302 to the lower housing 104, and the fastener 308 may extend through the slot 216 to attach the installation bracket 304 to the lower housing 104. The fasteners 306, 308 may be inserted into the respective slots 214, 216 from within the cavity of the lower housing 104. Alternatively, the fasteners 306, 308 may be inserted into the respective slots 214, 216 from outside of the lower housing 104.

In some example embodiments, the junction box 100 is a fire rated junction box. For example, the junction box 100 may be compliant with UL514A or another standard. To illustrate, the installation bracket 302 may enclose a portion of the slot 214 to reduce the size of the opening of the slot 214, and the installation bracket 304 may enclose a portion of the slot 216 to reduce the size of the opening of the slot 216. In some alternative embodiments, the slots 214, 216 may be sized to comply with one or more fire rating standards without the need to enclose the slots 214, 216 using the brackets 302, 304.

In some example embodiments, the fasteners 306, 308 may be vertically moveable in the respective slots 214, 216 to adjust the position of the respective brackets 302, 304. For example, the slots 214, 216 may enable adjustment of the position of the junction box 100, which may allow use of the junction box 100 with ceilings of various thicknesses and in spaces between a ceiling and support structures such as joists.

Figure 4:
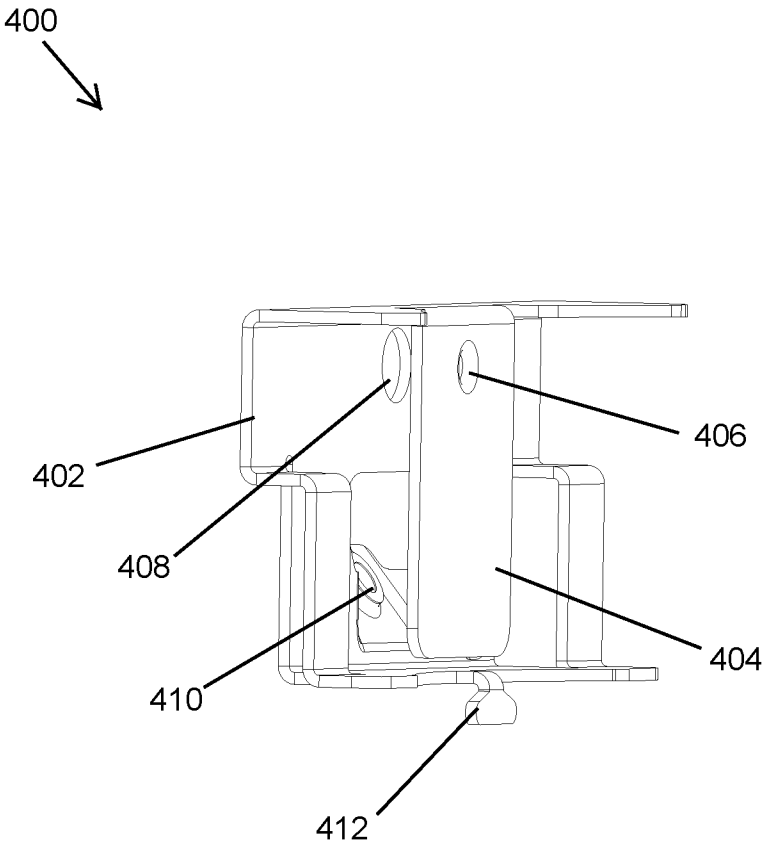
FIG. 4 illustrates an installation bracket of the junction box of FIG. 3 according to an example embodiment.

FIG. 4 illustrates an installation bracket 400 for use with the junction box 100 of FIG. 3 according to an example embodiment. In some example embodiments, the installation bracket 400 corresponds to each installation bracket 302, 304 shown in FIG. 3. Referring to FIGS. 1-4, the installation bracket 400 includes an outer wall 402 and an inner wall 404. The outer wall 402 may include a hole 408, and the inner wall 404 may include a hole 406. One or both of the holes 406, 408 may be designed to receive a threaded fastener, where the threaded fastener is screwed into one or both holes 406, 408. For example, one or both of the holes 406, 408 may be designed to receive the fastener 306, 308. In some example embodiments, the installation bracket 400 may also include a tab 412 that can be inserted in a slot (e.g., the slot 214) formed in the lower housing 104. For example, the tab 412 may serve to limit the lowest position of the installation bracket 400 with respect to the lower housing 104 and may also provide a stable attachment of the installation bracket 400 to the lower housing 104.

In some example embodiments, a hanger bar passes through the installation bracket 400. For example, the hanger bar that passes through the installation bracket 400 may be held in position by a fastener. To illustrate, the installation bracket 400 may include a hole 410 that receives a fastener that holds the hanger bar in a particular position.

In some example embodiments, the installation bracket 400 is attached to the lower housing 104 such that the inner wall 404 encloses at least a portion of the slot (e.g., the slot 214) in the lower housing 104. To illustrate, the installation bracket 302, which may be an instance of the installation bracket 400, may enclose at least a portion of the slot 214, and the installation bracket 304, which may be another instance of the installation bracket 400, may enclose at least portion of the slot 216. For example, enclosing at least a portion of the slots 214, 216 may enable the junction box 100 to be a fire rated junction box.

In some alternative embodiments, the installation bracket 400 may have other shapes without departing from the scope of this disclosure. In some alternative embodiments, one or more structural elements of the installation bracket 400 may be omitted without departing from the scope of this disclosure.

Figure 5:
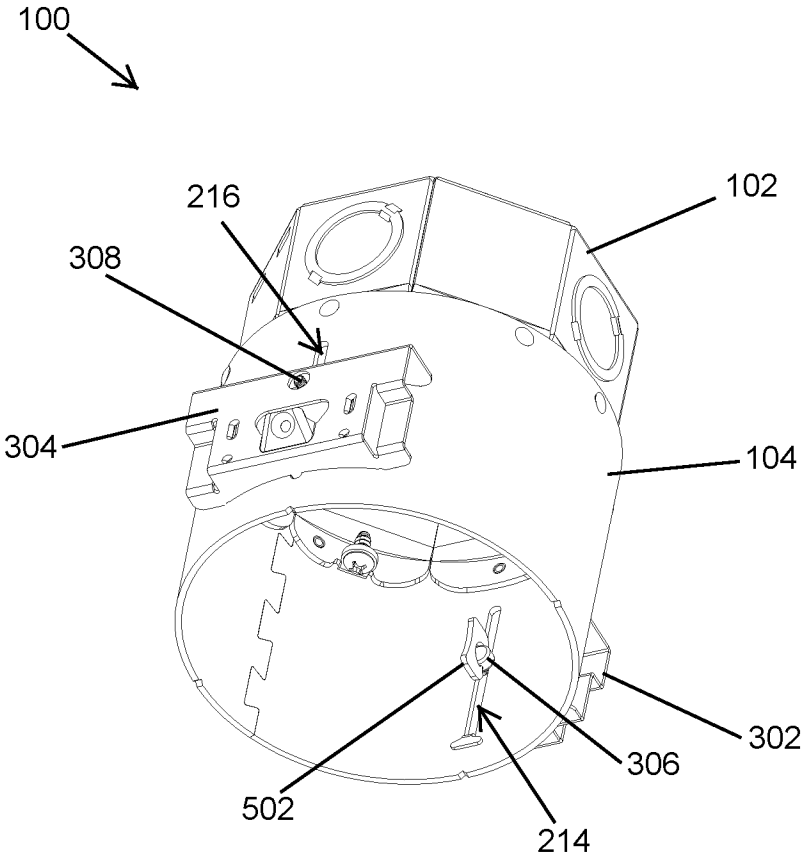
FIG. 5 illustrates a bottom perspective view of the junction box of FIG. 3 illustrating a folding fastener in an unfolded position according to an example embodiment.
Figure 6:
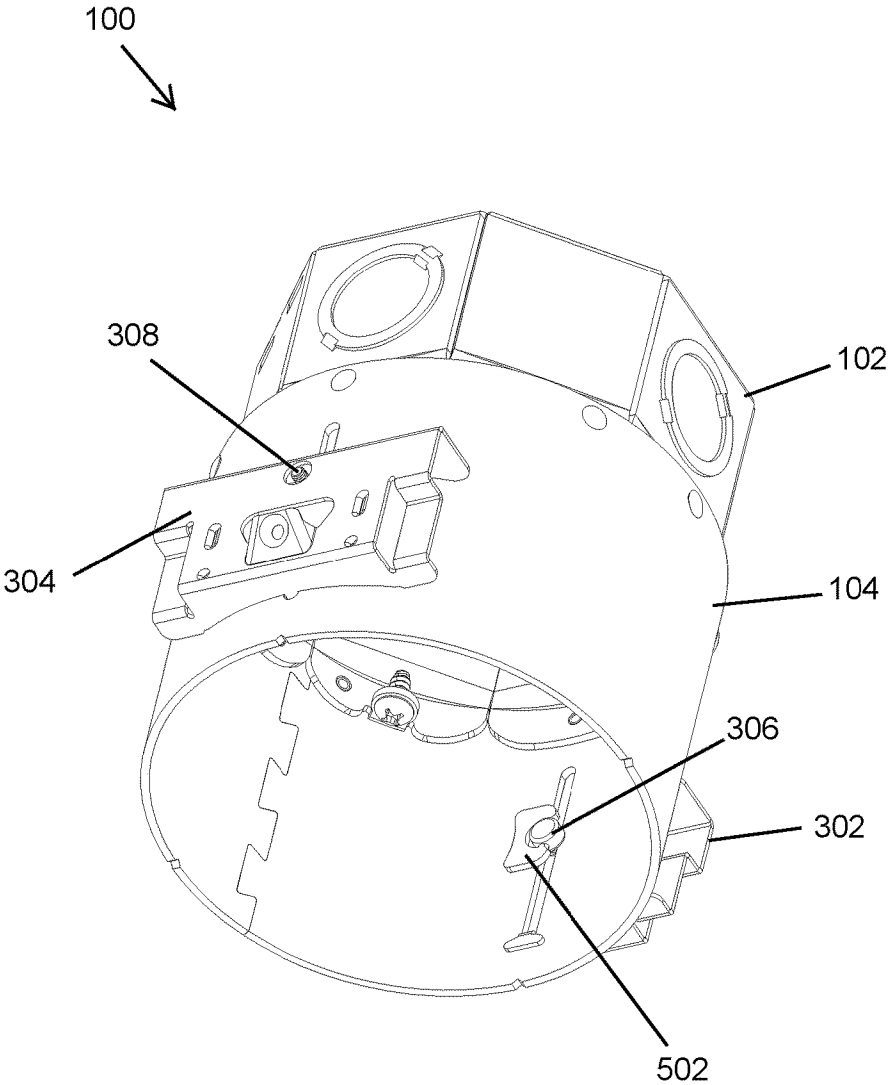
FIG. 6 illustrates a bottom perspective view of the junction box of FIG. 1 illustrating the folding fastener in a folded position according to an example embodiment.

FIGS. 5 and 6 illustrate a bottom perspective view of the junction box 100 of FIG. 3 illustrating the fastener 306 in unfolded and folded positions, respectively, according to an example embodiment. Referring to FIGS. 1-6, in some example embodiments, the fastener 306 may be similar to a wing screw, wherein the head/wing 502 is foldable to a position shown in FIG. 6. For example, the fastener 306 may be attached to the installation bracket 302 by inserting the fastener 306 through the slot 214 from inside the cavity of the lower housing 104. To illustrate, the foldable head 502 may be extended/unfolded as shown in FIG. 5, and an installer may fasten the fastener 306 using the foldable head 502 while the foldable head 502 is in the extended/unfolded position as shown in FIG. 5. After the fastener 306 is securely attached to the installation bracket 302, the foldable head 502 may be folded/collapsed to the position shown in FIG. 6. The folded position of the installation bracket 302 shown in FIG. 6 limits the interference of the fastener 306 with other components that may be in the cavity of the lower housing 104. Further, the foldable head 502 in the position shown in FIG. 6 helps retain the installation bracket 302 attached to the lower housing 104.

In some example embodiments, the vertical position of the installation bracket 302 may be changed with respect to the lower housing 104 by moving the foldable head 502 to the extended/unfolded position shown in FIG. 5 and moving the fastener 306 in the slot 214 after loosening the fastener 306, if necessary. After the installation bracket is moved in the desired position, the foldable head 502 may be put in the folded position shown in FIG. 6.

In some example embodiments, the fastener 308 may have a similar structure as the fastener 306 and may be used in a similar manner. For example, the installation bracket 304 may be secured and adjusted in the same manner as described with respect to the installation bracket 302.

Figure 7:
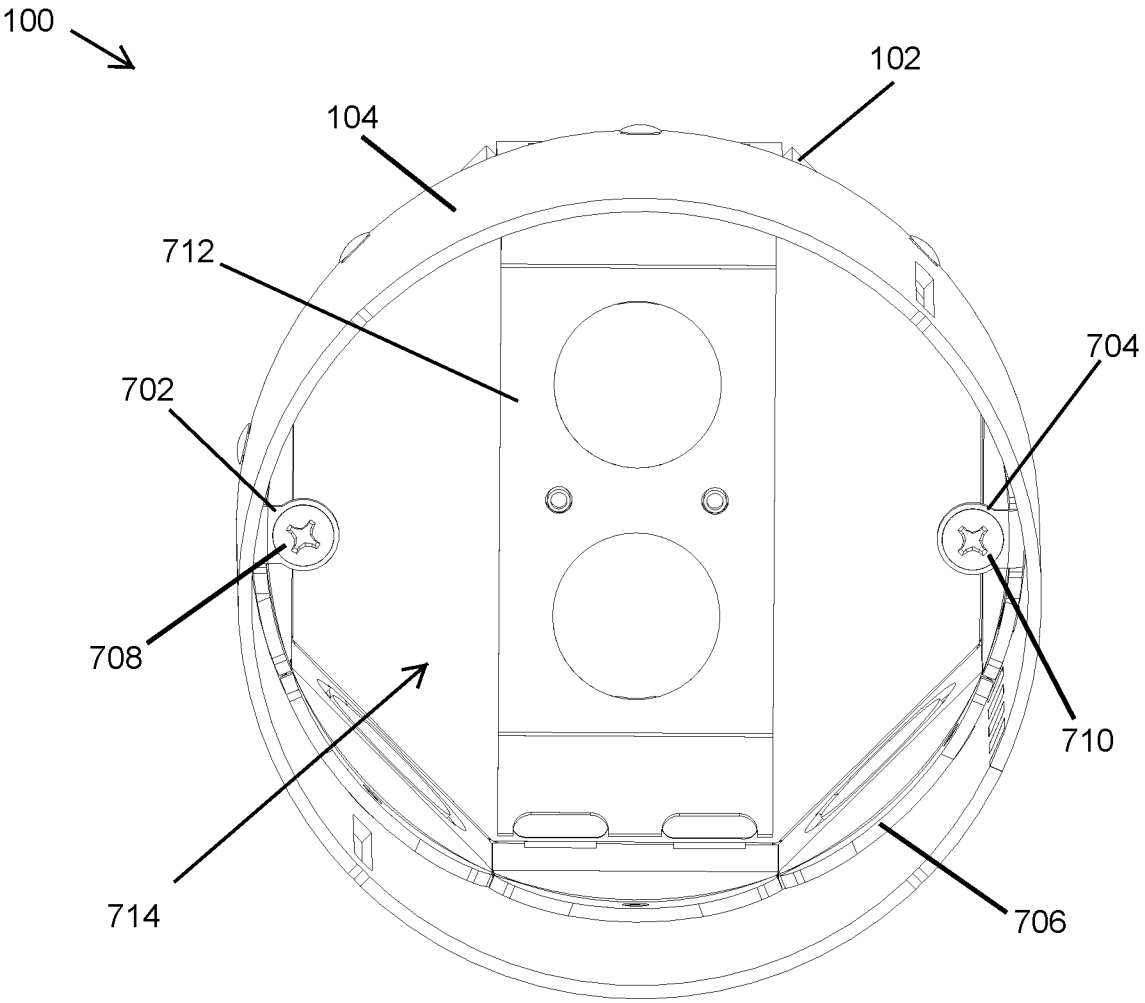
FIG. 7 illustrates a bottom perspective view of the junction box of FIG. 1 illustrating fasteners for securing a section bracket according to another example embodiment.

FIG. 7 illustrates a bottom perspective view of the junction box 100 of FIG. 1 illustrating fasteners 708, 710 for securing a section bracket according to another example embodiment. In some example embodiments, the junction box 100 may include tabs 702, 704 that are in a cavity 714 of the junction box 100. For example, the tabs 702, 704 may extend out inwardly from an edge 706 of the upper housing 102 that is inside the cavity of the lower housing 104. Alternatively, the tabs 702, 704 may extend out from another portion of the upper housing 102 or from the lower housing 104. In some example embodiments, the tabs 702, 704 may be diametrically opposite each other. Alternatively, the tabs 702, 704 may have different relative positions without departing from the scope of this disclosure.

In some example embodiments, each tab 702, 704 includes holes for insertion of the fasteners 708, 710, respectively. For example, the fasteners 708, 710 may be used to attach a bracket or another structure to the junction box 100 on the inside of the junction box 100.

In some alternative embodiments, the tabs 702, 704 may be positioned at different locations and may have different shapes than shown without departing from the scope of this disclosure. In some alternative embodiments, different types of fasteners may be used instead of the fasteners 708, 710.

In some example embodiments, a strain relief bracket 712 may be positioned in the cavity of the upper housing 102. For example, the strain relief bracket 712 may be used to retain a non-metallic sheathed cable—known as Romex wire—within the junction box 100 after the Romex wire is inserted into the junction box 100 through an opening formed by removing one of the knockout sections of the upper housing 102. In some alternative embodiments, the strain relief bracket 712 may be omitted or may be oriented differently than shown without departing from the scope of this disclosure. In some alternative embodiments, a different type of strain relief bracket may be used without departing from the scope of this disclosure.

Figure 8:
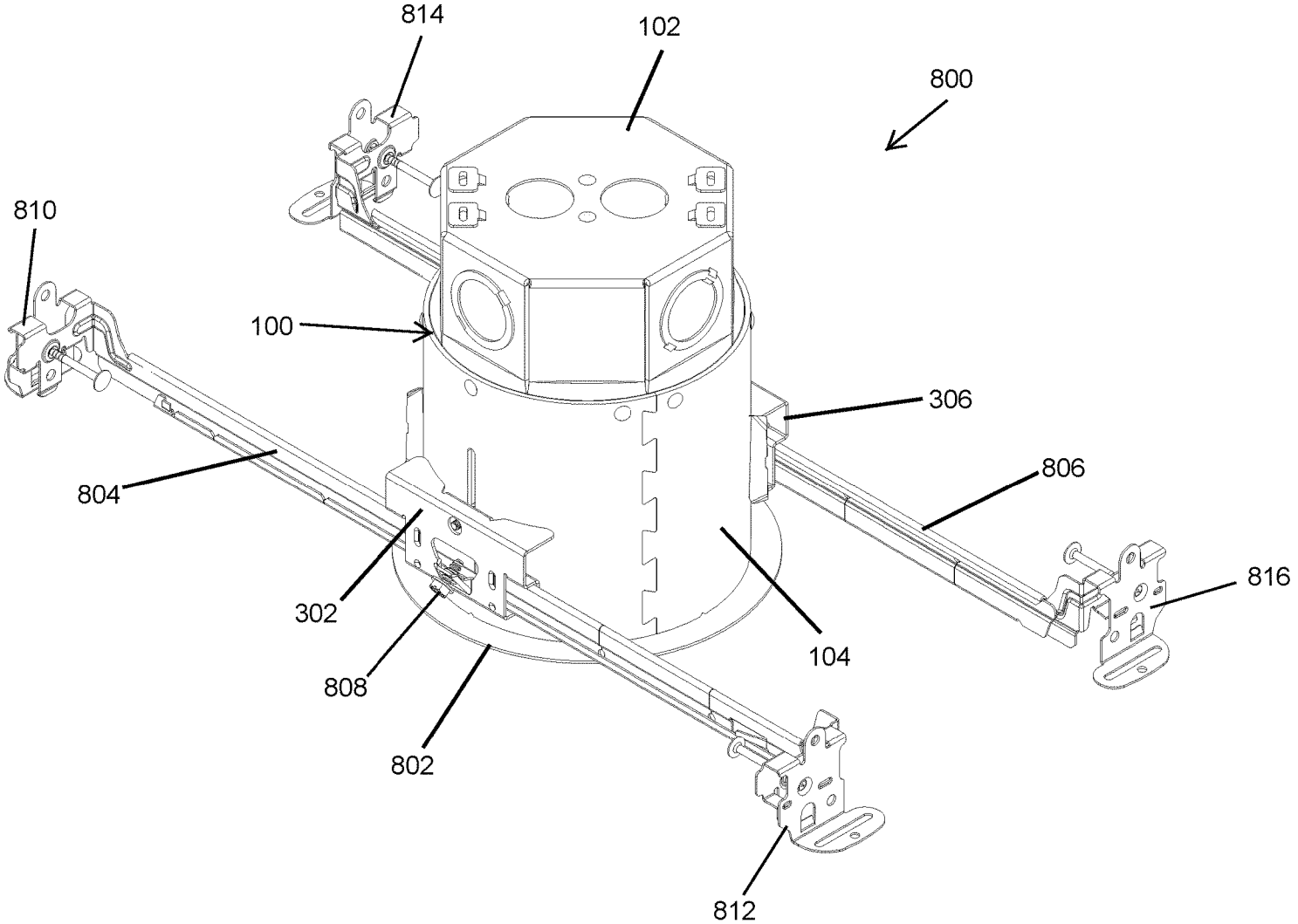
FIG. 8 illustrates a perspective view of a recessed lighting assembly including the junction box of FIGS. 1-3 and a light module according to an example embodiment.

FIG. 8 illustrates a perspective view of a recessed lighting assembly 800 including the junction box 100 of FIGS. 1-3 according to an example embodiment. Referring to FIGS. 1-8, in some example embodiments, the lighting assembly 800 includes the junction box 100 that includes the upper housing 102 and the lower housing 104. The lighting assembly 800 may also include a light module 802 that is at least partially positioned in the junction box 100. For example, the light module 802 may include a trim and a light source (e.g., a light emitting diode (LED) light source or a non-LED lamp). Line power (e.g., AC power) may be provided to the light module 802 using electrical wires that can be inserted into the junction box 100 through one or more openings that are formed by removing one or more of the knockout section in the upper housing 102.

In some example embodiments, the light module 802 may be positioned in the cavity of the lower housing 104. During or after installation of the lighting assembly 800, the light module 802 may be rotated within the cavity of the lower housing 104. For example, the light module 802 may be secured to the lower housing 104 by friction force between the light module 802 and the inner surface of the lower housing 104. Alternatively, the light module 802 may be secured to the lower housing 104 by other means without departing from the scope of this disclosure.

In some example embodiments, the lighting assembly 800 may be attached to hanger bars 804, 806 using the installation brackets 302, 304, respectively. For example, the attachment structures 810, 812 at the end portions of the hanger bar member 804 and attachment structures 814, 816 at the end portions of the hanger bar member 806 may be used to install the lighting assembly 800, for example, behind a ceiling. After the hanger bars 804, 806 are adjusted for desired lengths, the hanger bars 804, 806 may be secured in the desired positions using fasteners such as the fastener 808. In some alternative embodiments, other types of hanger bar or installation structures may be used to install the lighting assembly 800 in a recessed position.

In some example embodiments, the position of the lighting assembly 802 relative to a ceiling may be adjusted by adjusting the vertical positions of the brackets 302, 304 relative to the lower housing 104 as described above. For example, relative vertical positions of the hanger bars 804, 806 and the installation brackets 302, 304 with respect to the lower housing 104 may be higher than shown in FIG. 8 without departing from the scope of this disclosure. In some example embodiments, the lighting assembly 800 may be installed using structures and means other than the hanger bars 804, 806.

Figure 9:
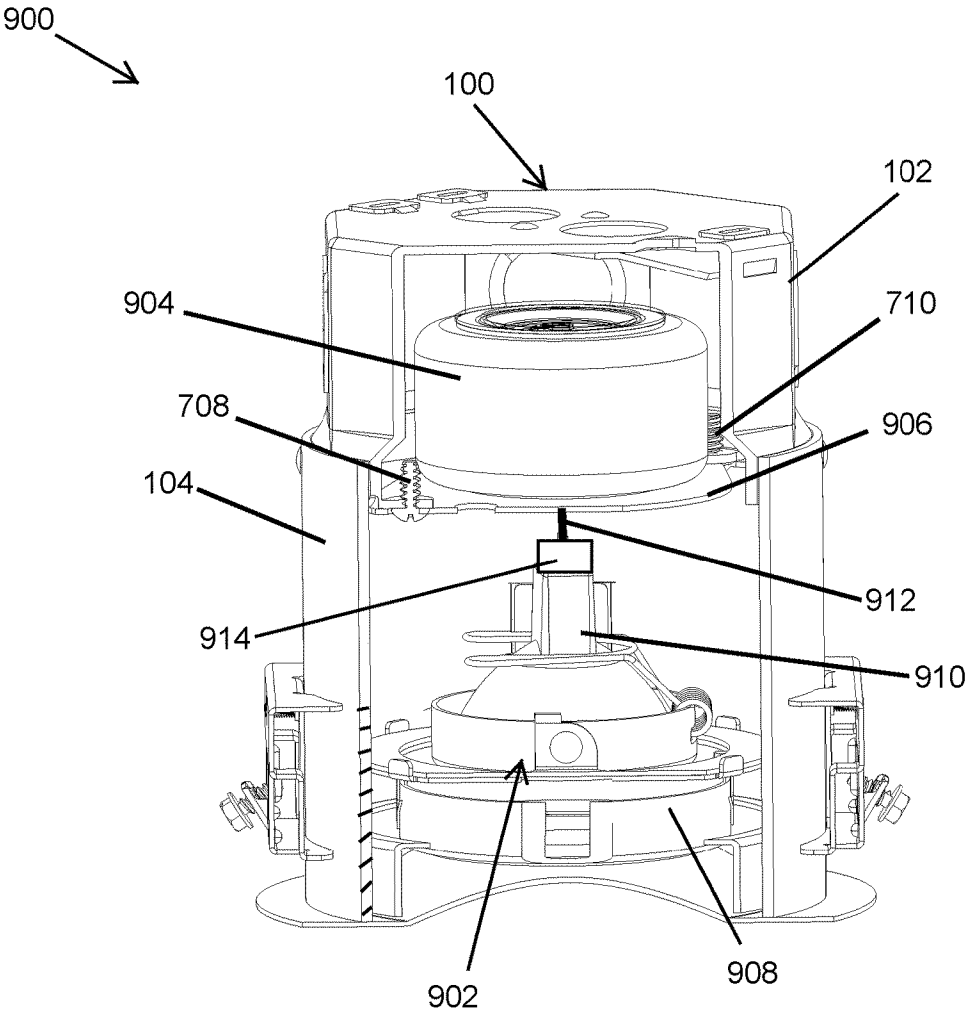
FIG. 9 illustrates a cross-sectional view of a recessed lighting assembly including the junction box of FIGS. 1-3 and a light module according to another example embodiment.

FIG. 9 illustrates a cross-sectional view of a recessed lighting assembly 900 including the junction box 100 of FIGS. 1-3 according to another example embodiment. In some example embodiments, the lighting assembly 900 corresponds to the lighting assembly 800 of FIG. 8. Referring to FIGS. 1-7 and 9, in some example embodiments, the lighting assembly 900 includes the junction box 100 that includes the upper housing 102 and the lower housing 104.

In some example embodiments, the lighting assembly 900 may also include a light module 902 that is positioned in the cavity of the lower housing 104. The light module 902 may include a trim 908 and a light source 910 (e.g., a lamp). The light module 902 may be rotatable within the lower housing 104. For example, the light module 902 may be retained inside the cavity of the lower housing 104 by friction force between one or more brackets of the trim 908 and the lower housing 104, allowing rotation of the light module 902 with the application of adequate rotation force from below. Alternatively, the light module 902 may be attached to the junction box 100 using other means without departing from the scope of this disclosure. In some example embodiments, the light module 902 may correspond to the light module 802 of FIG. 8 and may be installed in a similar manner.

In some example embodiments, the lighting assembly 900 includes a transformer 904 that receives a line power (e.g., mains power) and outputs a power signal (e.g., a power signal at 12 V) that is compatible with the light source 910. The transformer 904 may receive line power via electrical wires, that may be routed in a conduit, that are inserted into the cavity of the upper housing 102 through an opening formed by removing a knockout section (e.g., the knockout section 116) of the upper housing 102. Electrical connections may be made in the cavity of the upper housing 102 between the electrical wires inserted into the cavity of the upper housing 102 and one or more connectors and/or wires of the transformer 904.

In some example embodiments, the transformer 904 may be positioned on a section bracket 906 that is attached to the junction box 100 by the fasteners 708, 710. For example, the fasteners 708, 710 may securely attach the section bracket 906 through holes or notches in the section bracket 906 that line up with respective holes in the tabs 702, 704 shown in FIG. 7. In some example embodiments, the section bracket 906 may be detached from the tabs 702, 704 by first removing the fasteners 708, 710. Alternatively, the section bracket 906 may be detached from the tabs 702, 704 without fully removing the fasteners 708, 710. In some alternative embodiments, the section bracket 906 may be attached to the junction box 100 by other means without departing from the scope of this disclosure.

In some example embodiments, one or more electrical wires 912 may be routed from the transformer 904 to a socket 914 that is below the section bracket 906. For example, the one or more electrical wires 912 may be routed through one or more holes in the section bracket 906. For example, routing the one or more electrical wires 912 through properly a sized hole in the section bracket 906 may reduce the downward force that may otherwise be exerted on the light module 902.

In some alternative embodiments, the light module 902, the transformer 904, and the section bracket 906 may have shapes and dimensions other than shown without departing from the scope of this disclosure. In some alternative embodiments, other components may have shapes and dimensions other than shown without departing from the scope of this disclosure. In some alternative embodiments, the section bracket 906 may be located higher or lower than shown without departing from the scope of this disclosure. In some alternative embodiments, the light module 902 may have other components without departing from the scope of this disclosure. In some alternative embodiments, one or more components of the light module 902 may be omitted without departing from the scope of this disclosure.

Figure 10:
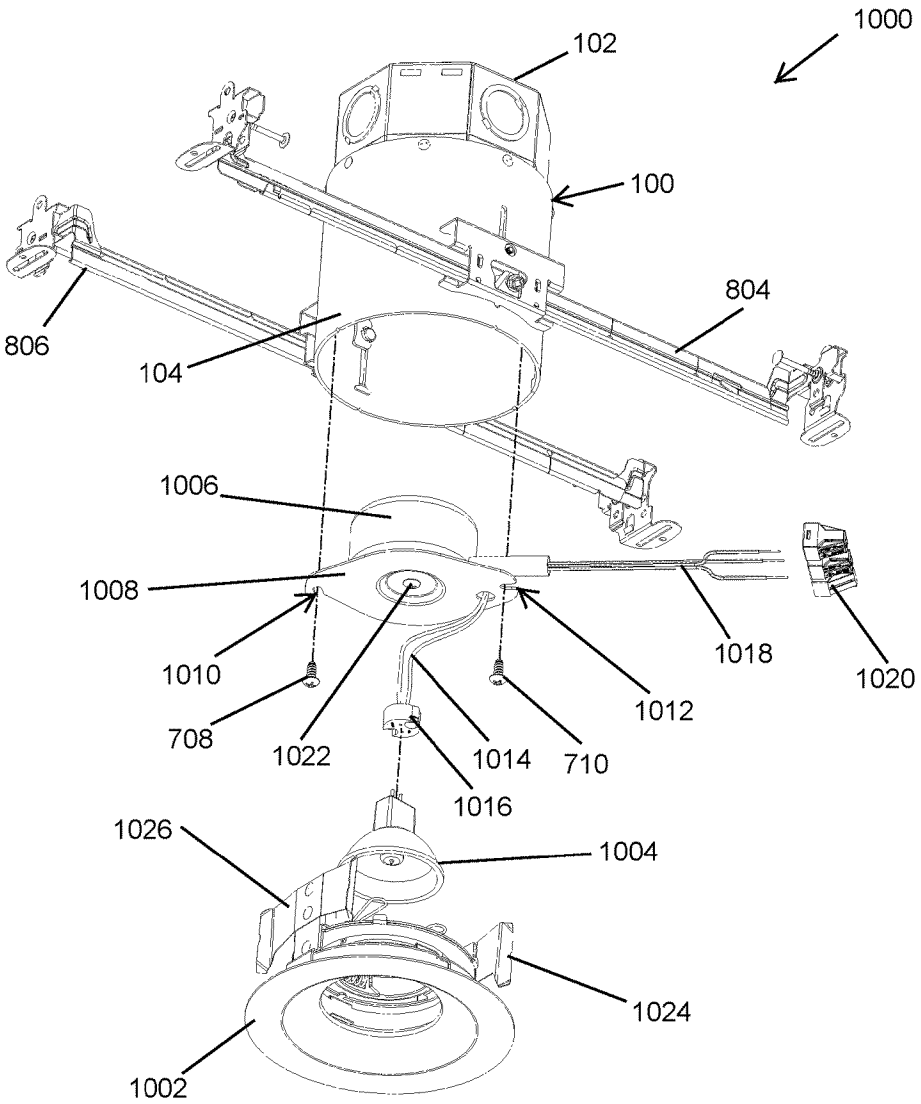
FIG. 10 illustrates an exploded view of a recessed lighting assembly including the junction box of FIGS. 1-3 and a light module according to another example embodiment.

FIG. 10 illustrates an exploded view of a recessed lighting assembly 1000 including the junction box 100 of FIGS. 1-3 according to another example embodiment. In some example embodiments, the lighting assembly 1000 corresponds to the lighting assembly 800 of FIG. 8. In some example embodiments, the lighting assembly 1000 corresponds to the lighting assembly 900 of FIG. 9. Referring to FIGS. 1-7 and 10, in some example embodiments, the lighting assembly 1000 includes the junction box 100 that includes the upper housing 102 and the lower housing 104.

In some example embodiments, the lighting assembly 1000 may also include a light module that includes a trim 1002 and a light source 1004 (e.g., a lamp). The light module may be rotatable within the lower housing 104 by rotating the trim 1002. For example, the light module may be retained inside the cavity of the lower housing 104 by friction force between one or more brackets 1024, 1026 of the trim 1002 and the lower housing 104, allowing rotation of the trim 1002 along with the attached light source 1004 with the application of adequate rotational force from below. Alternatively, the light module may be attached to the junction box 100 using other means without departing from the scope of this disclosure. In some example embodiments, the light module that includes the trim 1002 and the light source 1004 may correspond to the light module 802 of FIG. 8 or the light module 902 of FIG. 9 and may be installed in a similar manner.

In some example embodiments, the lighting assembly 1000 includes a transformer 1006 that receives a line power (e.g., mains power) and outputs a power signal (e.g., a power signal at 12 V) that is compatible with the light source 1004. The transformer 1006 may be secured to a section bracket 1008 using a fastener 1022. In some example embodiments, the transformer 1004 may correspond to the transformer 904 of FIG. 9 and may be attached and used in a similar manner as described above. For example, electrical connections may be made in the cavity of the upper housing 102 between the line power electrical wires inserted into the cavity of the upper housing 102 through an opening formed by removing a knockout section and one or more connectors 1020 and/or wires 1018 of the transformer 1006. The output power signal from the transformer 1006 may be provided to the light source 1004 using the electrical wire(s) 1014 routed through an opening in the section bracket 1006. The electrical wire(s) 1016 may be connected to a socket 1016 that may be plugged with the light source 1004.

In some example embodiments, the section bracket 1008 may correspond to the section bracket 906 of FIG. 9 and may be attached and used in a similar manner. For example, the section bracket 1008 may include notches 1010, 1012 for passing the fasteners 708, 710, respectively, therethrough to securely attach the section bracket 1008 to the tabs 702, 704 shown in FIG. 7. By orienting the notches 708, 710 as shown, in some example embodiments, the section bracket 1008 may be detached from the tabs 702, 704 by loosening the fasteners 708, 710 and without the need to fully remove the fasteners 708, 710 from the tabs 702, 704. For example, the section bracket 1008 may be rotated about the fastener 710 to detach the section bracket 1008 from the fastener 708, and the section bracket 1008 be subsequently removed from the fastener 710 by pulling the section bracket 1008 away from the fastener 710.

In some example embodiments, the lighting assembly 1000 may be installed using the hanger bars 804, 806 in a similar manner as described above. Alternatively, the lighting assembly 1000 may be installed other means without departing from the scope of this disclosure.

In some alternative embodiments, the trim 1002, the light source 1004, the transformer 1006, and the section bracket 1008 may have shapes and dimensions other than shown without departing from the scope of this disclosure. In some alternative embodiments, other components may have shapes and dimensions other than shown without departing from the scope of this disclosure. In some alternative embodiments, the light module of the lighting assembly 1000 may have components other than shown without departing from the scope of this disclosure. In some alternative embodiments, one or more components of the light module may be omitted without departing from the scope of this disclosure.

Figure 11:
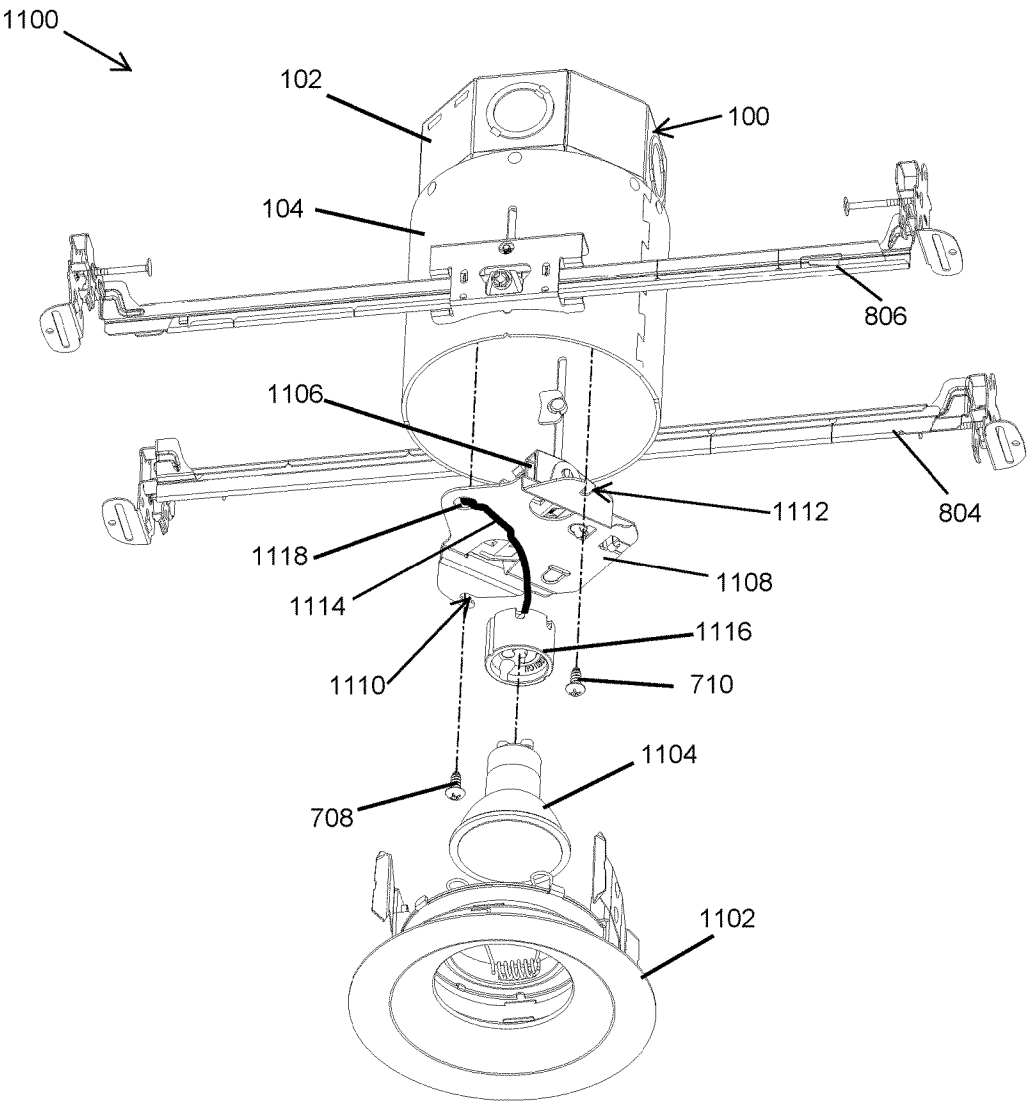
FIG. 11 illustrates an exploded view of a recessed lighting assembly including the junction box of FIGS. 1-3 and a light module according to another example embodiment.

FIG. 11 illustrates an exploded view of a recessed lighting assembly 1100 including the junction box 100 of FIGS. 1-3 according to another example embodiment. In some example embodiments, the lighting assembly 1100 corresponds to the lighting assembly 800 of FIG. 8. Referring to FIGS. 1-7 and 11, in some example embodiments, the lighting assembly 1100 includes the junction box 100 that includes the upper housing 102 and the lower housing 104.

In some example embodiments, the lighting assembly 1100 may include a light module that includes a trim 1102 and a light source 1104 (e.g., a lamp). The light module may be rotatable within the lower housing 104 by rotating the trim 1102. For example, the light module be retained inside the cavity of the lower housing 104 by friction force between one or more brackets of the trim 1102 and the lower housing 104 in a similar manner as described above with respect to FIG. 10. The retention of the trim 1102 and the light source 1104 based on frictional force allows rotation of the trim 1102 along with the attached light source 1104 with the application of adequate rotational force from below. Alternatively, the trim 1102 and the light source 1104 may be attached to the junction box 100 using other means without departing from the scope of this disclosure. In some example embodiments, the light module of the lighting assembly 1100 including the trim 1102 and the light source 1104 may correspond to the light module 802 of FIG. 8 and may be installed in a similar manner.

In some example embodiments, the lighting assembly 1100 includes a section bracket 1108 that may be attached to the junction box 100 using the fasteners 708, 710 in a similar manner as described above with respect to the section brackets 906, 1008. The section bracket 1108 may also be removed from the junction box 100 in a similar manner as described above with respect to the section brackets 906, 1008. For example, the section bracket 1108 may include notches 1110, 1112 that correspond to the notches 1010, 1012 shown in FIG. 10 and that may be used in a similar manner as described above. The section bracket 1108 serves to reduce the risk that the trim 1102 may be dislodged from the lower housing 104 by a downward force, for example, from electrical wires that are above the section bracket 1108 in a similar manner as the section brackets 906, 1008. Routing the electrical wires 1114 through the hole 1118 may also reduce the risk that downward force exerted by the electrical wires 1114 may dislodge the trim 1102 from the lower housing 104 in a similar manner as the section brackets 906, 1008.

In some example embodiments, a thermal control device may be positioned in the cavity of the upper housing 102, for example, on the section bracket 1108. In some alternative embodiments, the electrical connector(s) 1106 may not be attached to the section bracket 1108.

In some example embodiments, the lighting assembly 1000 may be installed using the hanger bars 804, 806 in a similar manner as described above. Alternatively, the lighting assembly 1000 may be installed other means without departing from the scope of this disclosure.

In some alternative embodiments, the trim 1102, the light source 1104, and the section bracket 1108 may have shapes and dimensions other than shown without departing from the scope of this disclosure. In some alternative embodiments, other components may have shapes and dimensions other than shown without departing from the scope of this disclosure. In some alternative embodiments, the light module of the lighting assembly 1100 may have components other than shown without departing from the scope of this disclosure. In some alternative embodiments, one or more components of the light module may be omitted without departing from the scope of this disclosure.

Figure 12:
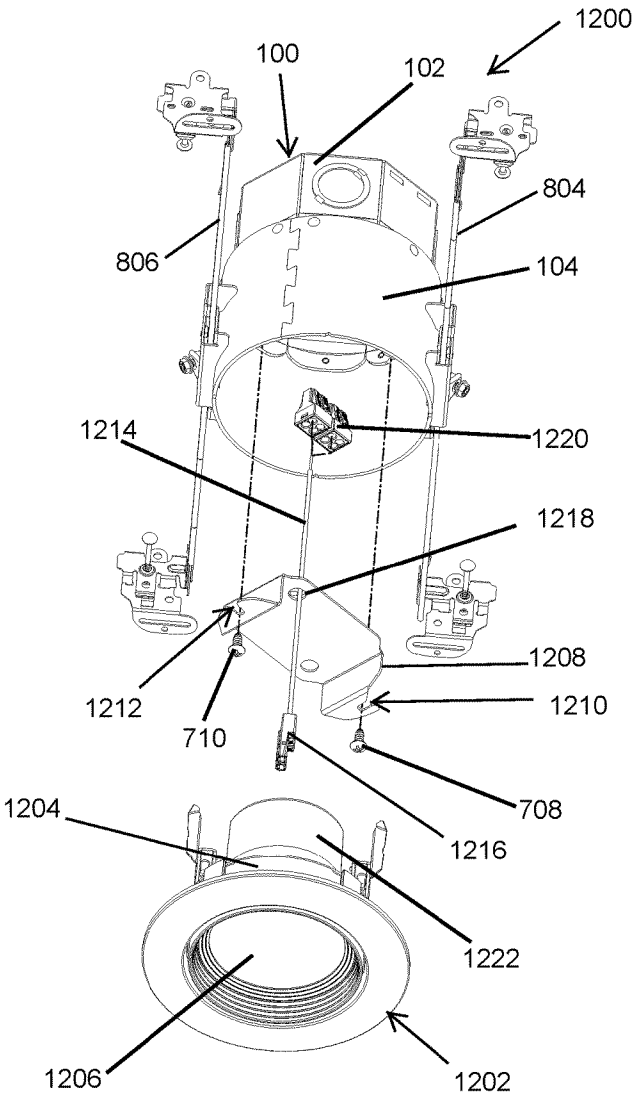
FIG. 12 illustrates an exploded view of a recessed lighting assembly including the junction box of FIGS. 1-3 and a light module according to another example embodiment.

FIG. 12 illustrates an exploded view of a recessed lighting assembly 1200 including the junction box 100 of FIGS. 1-3 according to another example embodiment. In some example embodiments, the lighting assembly 1200 corresponds to the lighting assembly 800 of FIG. 8. Referring to FIGS. 1-7 and 12, in some example embodiments, the lighting assembly 1200 includes the junction box 100 that includes the upper housing 102 and the lower housing 104.

In some example embodiments, the lighting assembly 1200 may include a light module 1202 that includes a trim 1204 and a light source 1206 (e.g., an LED light source that may be integrated with or separate with the trim 1204). The light module 1202 may be rotatable within the lower housing 104. For example, the light module 1202 may be retained inside the cavity of the lower housing 104 by friction force between one or more brackets of the light module 1202 and the lower housing 104 in a similar manner as described above with respect to FIG. 10. The retention of the light module 1202 based on frictional force allows rotation of the light module 1202 with the application of adequate rotational force from below. Alternatively, the trim 1202 may be attached to the junction box 100 using other means without departing from the scope of this disclosure. In some example embodiments, the light module 1202 may correspond to the light module 802 of FIG. 8 and may be installed in a similar manner.

In some example embodiments, the lighting assembly 1200 includes a section bracket 1202 that may be attached to the junction box 100 using the fasteners 708, 710 in a similar manner as described above with respect to the section brackets 906, 1008, 1108. The section bracket 1208 may also be removed from the junction box 100 in a similar manner as described above with respect to the section brackets 906, 1008, 1108. For example, the section bracket 1108 may include notches 1210, 1212 that correspond to the notches 1010, 1012 shown in FIG. 10 and that may be used in a similar manner as described above. The section bracket 1208 serves to reduce the risk that the light module 1202 may be dislodged from the lower housing 104 by a downward force, for example, from electrical wire(s) 1214. Routing the electrical wires 1214 through a hole 1218 may also reduce the risk that downward force exerted by the electrical wire(s) 1214 may dislodge the light module 1202 from the lower housing 104.

In some example embodiments, electrical connections are made above the section bracket 1202, for example by connecting one or more electrical wires routed into the cavity of the upper housing 102 with one or more connectors 1220 that may be connected to the one or more electrical wires 1214. One or more connectors 1216 connected to the one or more electrical wires 1214 may be attached to a driver 1222 (e.g., an LED driver) that provides power to the light module 1202. In some example embodiments, the driver 1222 may be integrated with the light module 1202.

In some example embodiments, the lighting assembly 1200 may be installed using the hanger bars 804, 806 in a similar manner as described above. Alternatively, the lighting assembly 1200 may be installed other means without departing from the scope of this disclosure.

In some alternative embodiments, the light module 1202 and other components of the lighting assembly 1200 may have shapes and dimensions other than shown without departing from the scope of this disclosure. In some alternative embodiments, the light module 1202 may have components other than shown without departing from the scope of this disclosure. In some alternative embodiments, one or more components of the light module 1202 may be omitted without departing from the scope of this disclosure. In some example embodiments, the lower housing 104 may have a shorter height in FIG. 12 as compared to the embodiments shown in FIGS. 9-11. Uses of the phrases upper housing and lower housing are not intended to limit the use of the junction box 100 to a single orientation. In some alternative embodiments of FIGS. 8-12, wire connections inside the junction box 100 may be made in a different manner than described without departing from the scope of this disclosure.

Although particular embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. A junction box for a regressed light module, comprising:

an upper housing having a top wall and perimeter walls, wherein the perimeter walls form a polygonal shape;

a lower housing having a cylindrical shape, the lower housing having a cavity for receiving a light module, wherein the lower housing is attached to the upper housing and wherein a cavity of the upper housing and the cavity of the lower housing form a cavity of the junction box; and an installation bracket attached to the lower housing using a fastener that extends through a slot in the lower housing, wherein the fastener includes a foldable head that is positioned inside the lower housing, wherein the foldable head is unfolded away from an inner surface of the lower housing to loosen the fastener, and wherein the foldable head is foldable against the inner surface of the lower housing after tightening the fastener.

2. The junction box of claim 1, wherein the upper housing includes one or more knockout sections that are removable to form an opening for passing an electrical wire into the junction box.

3. The junction box of claim 2, wherein at least one perimeter wall has a flat surface and wherein a knockout section of the one or more knockout sections is formed in the perimeter wall.

4. The junction box of claim 1, further comprising a section bracket positioned inside of the junction box, wherein the section bracket is positioned to separate the light module from at least a portion of the cavity of the upper housing.

5. The junction box of claim 1, further comprising a second installation bracket that is attached to the lower housing.

6. The junction box of claim 5, further comprising a second slot formed in the lower housing, wherein the second installation bracket is attached to the lower housing using a second fastener that extends through the second slot.

7. The junction box of claim 6, wherein the installation bracket is vertically moveable by moving the fastener in the slot and wherein the second installation bracket is vertically moveable by moving the second fastener in the second slot.

8. The junction box of claim 5, wherein the junction box is a fire rated junction box.

9. The junction box of claim 1, wherein a portion of the upper housing is positioned in the cavity of the lower housing and attached to the lower housing by one or more fasteners to securely attach the upper housing to the lower housing.

10. A recessed lighting assembly, comprising:

a junction box comprising:

an upper housing having a top wall and perimeter walls, wherein the perimeter walls form a polygonal shape;

a lower housing having a cylindrical shape, wherein the lower housing is attached to the upper housing and wherein a cavity of the upper housing and a cavity of the lower housing form a cavity of the junction box; and an installation bracket attached to the lower housing using a fastener that extends through a slot in the lower housing, wherein the fastener includes a foldable head that is positioned inside the lower housing, wherein the foldable head is unfolded away from an inner surface of the lower housing to loosen the fastener, and wherein the foldable head is foldable against the inner surface of the lower housing after tightening the fastener; and a light module positioned in the cavity of the lower housing.

11. The recessed lighting assembly of claim 10, wherein the light module comprises a light source and a trim.

12. The recessed lighting assembly of claim 11, wherein the light source is a light emitting diode (LED) light source.

13. The recessed lighting assembly of claim 11, wherein the light source is a non-light emitting diode light source.

14. The recessed lighting assembly of claim 11, wherein the trim is attached to the lower housing by friction between attachment brackets of the trim that press against the lower housing.

15. The recessed lighting assembly of claim 10, further comprising a section bracket attached to the junction box above the light module and at least partially separating an upper portion of the junction box from a lower portion of the junction box.

16. The recessed lighting assembly of claim 15, further comprising a transformer positioned on the section bracket on an opposite side of the section bracket from the light module.

17. The recessed lighting assembly of claim 15, wherein one or more wire connectors and the light module are positioned on opposite sides of the section bracket with respect to each other.

18. The recessed lighting assembly of claim 10, wherein the upper housing includes one or more knockout sections that are removable to form an opening for passing an electrical wire into the junction box.

19. The recessed lighting assembly of claim 10, further comprising a first installation bracket and a second installation bracket that are attached to the lower housing.

* * * * *